US011053689B2

(12) United States Patent
Zimbric et al.

(10) Patent No.: US 11,053,689 B2
(45) Date of Patent: Jul. 6, 2021

(54) MULTI-PIECE BATH OR SHOWER WALL

(71) Applicant: Kohler Co., Kohler, WI (US)

(72) Inventors: Luke Benjamin Zimbric, Grafton, WI (US); Kyle A. Marten, Sheboygan Falls, WI (US); Erika Kövesdi, Kohler, WI (US)

(73) Assignee: KOHLER CO., Kohler, WI (US)

( * ) Notice: Subject to any disclaimer, the term of this patent is extended or adjusted under 35 U.S.C. 154(b) by 0 days.

(21) Appl. No.: 16/528,017

(22) Filed: Jul. 31, 2019

(65) Prior Publication Data

US 2021/0032874 A1 Feb. 4, 2021

(51) Int. Cl.
*E04F 13/08* (2006.01)
*A47K 3/28* (2006.01)
*A47K 3/00* (2006.01)

(52) U.S. Cl.
CPC ..... *E04F 13/0894* (2013.01); *A47K 3/008* (2013.01); *A47K 3/284* (2013.01)

(58) Field of Classification Search
CPC ..... E04F 13/0894; A47K 3/008; A47K 3/284
USPC ..... 52/35; 4/584, 614
See application file for complete search history.

(56) References Cited

U.S. PATENT DOCUMENTS 1,656,410 A * 1/1928 Baer ..... A47K 3/284 4/614
3,149,347 A * 9/1964 Embroden ..... A47K 3/284 52/262
3,281,172 A * 10/1966 Kuehl ..... A47K 3/284 52/592.1
3,827,086 A 8/1974 Seymour et al.
4,080,710 A * 3/1978 Hess ..... B29C 65/562 264/157
4,316,295 A * 2/1982 Whitney ..... A47K 3/284 312/265.5
4,539,721 A * 9/1985 Moore ..... A47K 3/284 4/613
4,553,276 A * 11/1985 Paradis ..... A47K 3/284 4/596
4,578,832 A * 4/1986 Primucci ..... A47K 3/284 4/614
4,901,380 A * 2/1990 Smith ..... A47K 3/001 4/596
4,987,619 A * 1/1991 Smith ..... A47K 3/20 4/595
5,263,208 A * 11/1993 Smith ..... A47K 3/284 4/596

(Continued)

FOREIGN PATENT DOCUMENTS

JP 2005336964 12/2005

*Primary Examiner* — Brent W Herring
(74) *Attorney, Agent, or Firm* — Foley & Lardner LLP

(57) ABSTRACT

Disclosed is a bath wall assembly. The bath wall assembly includes a first back wall panel and a second back wall panel. Each of the back wall panels are configured to be mounted to a structural wall of a bathroom. The first back wall panel includes a flange that extends at least partially along an edge of the first back wall panel. The second back wall panel includes a channel configured to receive a portion of the flange therein. The channel is configured to prevent relative movement between the first back wall panel and the second back wall panel in a vertical direction. Together, the flange and the channel form a substantially water-tight seam between the first back wall panel and the second back wall panel.

15 Claims, 15 Drawing Sheets

(56) References Cited

U.S. PATENT DOCUMENTS 5,337,525 A * 8/1994 Zaccai ..... A47K 3/003 4/578.1
5,671,489 A * 9/1997 Salach ..... A47K 3/282 4/584
5,778,464 A * 7/1998 Chapple ..... A47K 3/008 4/584
6,425,147 B1 * 7/2002 Hanson ..... A47K 3/30 4/584
7,634,823 B2 * 12/2009 Sisk ..... A47K 3/30 4/614
8,082,608 B2 * 12/2011 Dabrowski ..... A47K 3/04 4/580
8,332,972 B2 * 12/2012 Bullis ..... A47K 3/30 4/584
8,752,219 B2 * 6/2014 Hoernig ..... E03C 1/24 4/578.1
8,850,632 B2 * 10/2014 Bullis ..... A47K 3/30 4/584
8,918,927 B1 * 12/2014 Smith ..... A47K 3/284 4/619
9,009,881 B2 * 4/2015 Sisk ..... A47K 3/30 4/614
9,084,516 B2 * 7/2015 Wilkinson ..... A47K 3/284
9,226,623 B2 * 1/2016 Geels ..... A47K 3/284
9,364,120 B2 * 6/2016 Zimbric ..... A47K 3/008
9,642,500 B2 * 5/2017 Groner ..... A47K 3/30
9,756,986 B2 * 9/2017 Zimbric ..... A47K 3/00
9,833,111 B2 * 12/2017 Torres ..... A47K 3/30
10,165,903 B2 * 1/2019 Zimbric ..... A47K 3/03
10,433,680 B2 * 10/2019 Zimbric ..... A47K 3/008
2008/0250558 A1 * 10/2008 Torres ..... A47K 3/30 4/614
2009/0172875 A1 * 7/2009 Dabrowski ..... A47K 3/04 4/584
2010/0058531 A1 * 3/2010 Bullis ..... A47K 3/30 4/584
2010/0325969 A1 * 12/2010 Hourihan ..... A47K 3/008 52/35
2011/0056014 A1 * 3/2011 Wilkinson ..... A47K 3/30 4/613
2012/0005967 A1 * 1/2012 Hourihan ..... A47K 3/008 52/35
2012/0036794 A1 * 2/2012 Dabrowski ..... A47K 3/04 52/35
2013/0254983 A1 * 10/2013 Geels ..... A47K 3/16 4/592
2014/0259362 A1 * 9/2014 Zimbric ..... A47K 3/16 4/584
2014/0259369 A1 * 9/2014 Zimbric ..... A47K 3/00 4/612
2015/0107018 A1 * 4/2015 Vagedes ..... A47K 3/02 4/584
2016/0045078 A1 * 2/2016 Zimbric ..... A47K 3/008 4/584
2017/0332847 A1 * 11/2017 Zimbric ..... A47K 3/00
2019/0069729 A1 * 3/2019 Zimbric ..... A47K 3/008
2020/0015634 A1 * 1/2020 Zimbric ..... A47K 3/008

* cited by examiner

MULTI-PIECE BATH OR SHOWER WALL

BACKGROUND

The present disclosure relates generally to the field of bath and shower inserts. More specifically, the present disclosure relates to a multi-piece wall assembly for a bath or shower insert.

SUMMARY

One exemplary embodiment relates to a bath wall assembly. The bath wall assembly includes a first back wall panel and a second back wall panel. The first back wall panel is configured to be mounted to a structural wall of a bathroom. The first back wall panel includes a flange that extends at least partially along an edge of the first back wall panel. The second back wall panel is configured to be mounted to the structural wall adjacent to the first back wall panel. The second back wall panel includes a channel configured to receive a portion of the flange therein and to prevent movement of the first back wall panel relative to the second back wall panel in a vertical direction. Together, the flange and the channel form a substantially water-tight seam between the first back wall panel and the second back wall panel.

Another exemplary embodiment relates to a bath wall assembly. The bath wall assembly includes an upper back wall panel and a lower back wall panel. The upper back wall panel is configured to be mounted to a structural wall of a bathroom. The upper back wall panel includes a flange extending at least partially along a lower edge of the upper back wall panel. The lower back wall panel is configured to be mounted to the structural wall below the upper back wall panel. The lower back wall panel includes a channel extending at least partially along an upper edge of the lower back wall panel. The channel is configured to receive a portion of the flange therein to form a water-tight seam between the upper back wall panel and the lower back wall panel. The upper back wall panel at least partially conceals a horizontal seam between the upper back wall panel and the lower back wall panel beneath the flange when the upper back wall panel is engaged with the lower back wall panel.

Yet another exemplary embodiment is a method of installing a bath wall assembly. The method includes engaging a lower edge of a lower back wall panel with a bath or shower insert. The method additionally includes engaging a portion of a flange of an upper back wall panel with a channel of the lower back wall panel. The channel is configured to prevent movement of the upper back wall panel relative to the lower back wall panel in a vertical direction. Together, the flange and the channel define a substantially water-tight seam between the upper back wall panel and the lower back wall panel.

DETAILED DESCRIPTION

Figure 1:
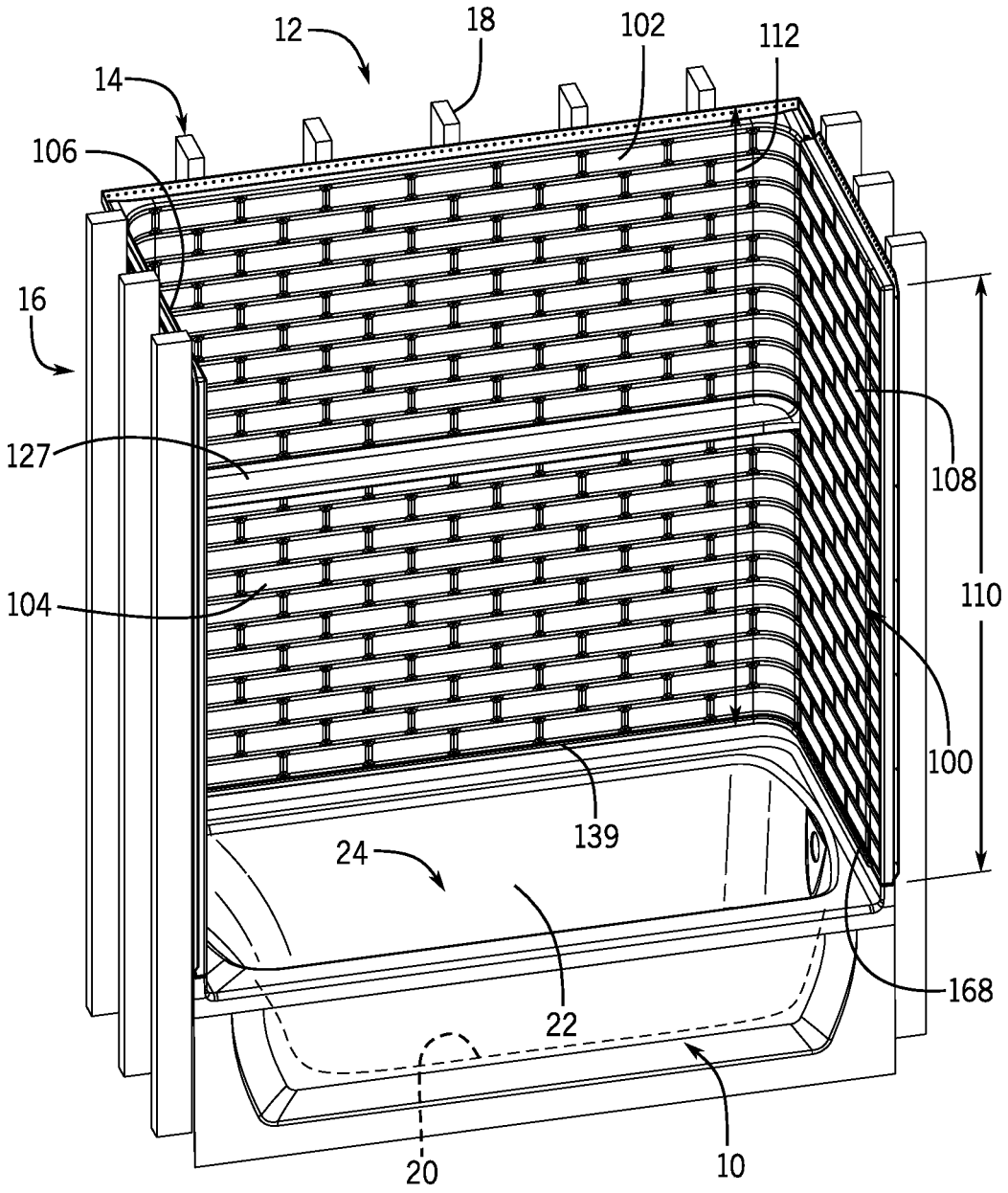
FIG. 1 is a perspective view of a bath wall assembly for a bathing insert, according to an exemplary embodiment.

Bath and shower inserts generally include upright walls to prevent water from escaping the bath/shower enclosure and leaking into exterior walls that surround the bath/shower enclosure. The walls are often integrally formed with the insert to ensure a water-tight seal is maintained between the bath/shower enclosure and the exterior walls. However, the overall size of these integrally formed bath and shower inserts can make them difficult to handle. To reduce the overall package size, the bath or shower insert may include a separate wall assembly that includes no more than two or three separate wall pieces to minimize the number of exposed seams that water may pass through. A sealant material (e.g., caulk, silicone sealant, etc.) is applied to the seams after assembly to reduce the potential for leaks. These sealant materials may be difficult to apply and do not guarantee a water-tight seal. Moreover, the sealant material does not completely hide the seams between adjacent wall sections, which reduces the overall aesthetic of the bath/shower enclosure.

Referring generally to the figures, a bath wall assembly is shown to include a plurality of wall panels (e.g., pieces, sections, etc.). The bath wall assembly engages with a bath or shower insert within a bath or shower enclosure, respectively, to substantially prevent water from leaking into structural walls (e.g., greenboard, plywood, etc.) that surround the bath/shower enclosure. The bath wall assembly includes four separate wall panels that are configured to sealably engage with one another to form a water-tight seal without the use of a sealant material. In particular, the bath wall assembly includes a two-piece back wall section, and two end wall panels. The back wall section includes a lower back wall panel and an upper back wall panel that are configured to be disposed at different vertical positions along a rear wall of the bath/shower enclosure. Among other benefits, separating the back wall panel into multiple pieces reduces the overall footprint of the packaging for the bath wall assembly, thereby making the packaged bath wall assembly easier and safer to handle.

Each wall panel of the bath wall assembly is configured to be mounted to a structural support wall within a bathroom environment. The lower back wall panel is configured to be mounted to the structural wall below the upper back wall panel. The upper back wall panel includes a flange (e.g., ledge, protrusion, etc.) that extends outwardly from the upper back wall panel in a substantially perpendicular orientation relative to the upper back wall panel. Among other benefits, the flange functions as a shelf upon which an occupant of the bath/shower enclosure may place various bathing accessories (e.g., shampoos, soaps, washcloths, brushes, and/or other bathing accessories).

The lower back wall panel includes a channel that extends at least partially along an upper edge of the lower back wall panel. In some embodiments, the channel is configured to extend in a substantially horizontal direction (e.g., left-to-right, etc.) when installed within the bath/shower enclosure (e.g., when mounted to the structural wall). A lower portion of the flange is configured to sealably engage with the channel to form a substantially water-tight seam between the upper back wall panel and the lower back wall panel in which water is prevented from leaking between the panels without the use of a sealant material. Similar to the channel, the seam extends in a horizontal direction, substantially parallel to a floor of the bath/shower enclosure (e.g., a floor of the bath/shower insert). The channel is sized and shaped to prevent the upper back wall panel from moving relative to the lower back wall panel in a substantially vertical direction (e.g., parallel to gravity). In some embodiments, the flange is configured to at least partially conceal the seam beneath the flange when the upper back wall panel is engaged with the lower back wall panel. In other words, the flange is configured such that the seam is obscured from an occupants view while standing within the bath/shower enclosure, which, advantageously, improves the overall aesthetic of the bath wall assembly. These and other advantageous features will become apparent to those reviewing the present disclosure and figures.

Referring to FIG. 1, a bath wall assembly 100 for a bathing insert 10 is shown, according to an exemplary embodiment. The bath wall assembly 100 includes a plurality of substantially vertical walls (e.g., upright walls, parallel to a direction of gravity, etc.) used to prevent water from escaping from a bathing enclosure 12 above the bathing insert 10. The bathing insert 10 is configured to accommodate a user and to direct water from a showerhead and/or faucet into a drain. In the embodiment of FIG. 1, the bathing insert 10 is a bathtub. In other embodiments, the bathing insert may be a floor piece for a shower. The bath wall assembly 100 extends upwardly (e.g., vertically upward, parallel to a gravity direction) from the bathing insert 10 along a portion of a perimeter of the bathing insert 10. As shown in FIG. 1, the bath wall assembly 100 includes four wall panels, two pieces that substantially cover a back portion 14 of a structural wall of the bathing enclosure 12 and two end pieces that substantially cover two side portions 16 of the structural wall that extend outwardly from the back portion 14 in substantially perpendicular orientation relative to the back portion 14.

As shown in FIG. 1, the structural wall is typically part of a house, commercial property, or another building structure. The structural wall may include a plurality of stringers, studs, or frame members 18 and a backing wall (not shown). The frame members 18 may be arranged to support the backing wall along a length of the backing wall (i.e., along a perimeter of the bathing enclosure 12). In the exemplary embodiment of FIG. 1, the bath wall assembly 100 is directly mounted to the frame members 18 of the structural wall. In other embodiments, the bath wall assembly 100 may be at least partially mounted to a backing wall. Each wall panel is coupled to the structural wall using a plurality of fasteners (e.g., screws) and/or an adhesive material such as glue, silicone caulk (e.g., RTV silicone), or another suitable adhesive. Together, the wall panels are configured to provide a water-tight seal between the enclosed bathing space and the structural wall without the use of a sealant material between seams of the wall panels. In some embodiments, the wall panels may be made from a polymeric composite material such as Vikrell™ by Kohler Co. or another suitable plastic or composite material.

As shown in FIG. 1, the bath wall assembly 100 includes a first back wall panel, shown as upper back wall panel 102, a second back wall panel, shown as lower back wall panel 104, and two end wall panels including a left side end wall panel 106 and a right side end wall panel 108. The lower back wall panel 104, the left side end wall panel 106, and the right side end wall panel 108 are engaged to an upper edge of the bathing insert 10 along a perimeter of the bathing insert 10. Additionally, each of the wall panels are sealably engaged to one another. The lower back wall panel 104 is disposed vertically below the upper back wall panel 102 such that the lower back wall panel 104 is "sandwiched" between the upper back wall panel 102 and the bathing insert 10. Together, the lower back wall panel 104 and the upper back wall panel 102 form (e.g., define) a substantially water-tight seam that prevents water from escaping the bathing enclosure 12 without the use of a sealant material. As used herein, a substantially water-tight seam refers to a region of engagement between surfaces of the upper back wall panel 102 and the lower back wall panel 104 through which water cannot pass or is substantially prevented from passing such that a sealant material is not required to maintain a sufficiently water-tight seal.

The left side end wall panel 106 is sealably engaged with both the upper back wall panel 102 and the lower back wall panel 104 along a substantially vertical edge (e.g., left side edge) of the upper back wall panel 102 and the lower back wall panel 104. The right side end wall panel 108 is sealably engaged with both the upper back wall panel 102 and the lower back wall panel 104 along a right side edge of the upper back wall panel 102 and the lower back wall panel 104. Each of the end wall panels 106, 108 is arranged in a substantially perpendicular orientation relative to the upper back wall panel 102 and the lower back wall panel 104. As shown in FIG. 1, a height 110 of the end wall panels 106, 108 is approximately equal to a combined height 112 of the upper back wall panel 102 and the lower back wall panel 104. In addition to providing a water-tight barrier between the bathing enclosure 12 and the surrounding structure of the bathroom, the bath wall assembly 100 also improves the aesthetic of the bath or shower. In the exemplary embodiment of FIG. 1, each wall panel of the bath wall assembly 100 is patterned with brick or tile shaped elements to simulate a brick or tile wall. In other exemplary embodiments, the design of the wall panels may be different and may include other aesthetically appealing patterns, shapes, colors, etc.

Figure 2:
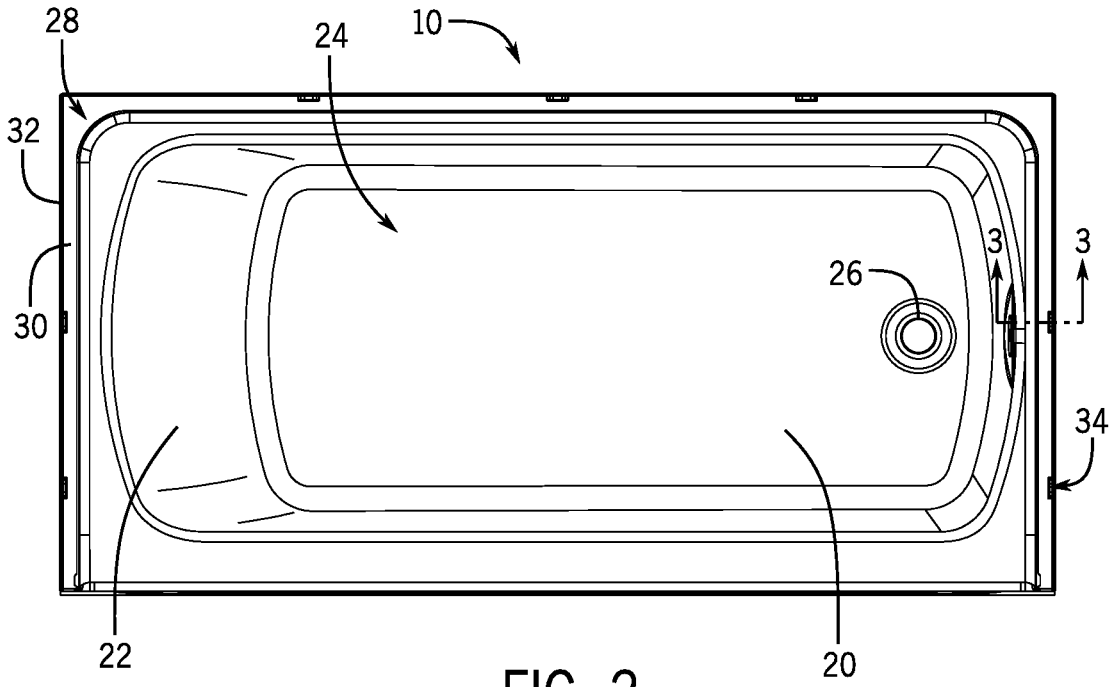
FIG. 2 is a top view of the bathing insert of FIG. 1.

Referring to FIG. 2, a top view of the bathing insert 10 is shown, according to an exemplary embodiment. In some embodiments, the bathing insert 10 is configured to retrofit an existing bath or shower fixture (e.g., the bathing insert 10 may be configured to be placed over an existing bath or shower). In other embodiments, the bathing insert 10 is configured as a standalone bath or shower fixture. The bathing insert 10 includes a floor 20 and a plurality of side walls 22 extending upwardly from the floor 20 in a sloped or substantially perpendicular orientation relative to the floor 20. Together, the floor 20 and the plurality of side walls 22 define a cavity 24 configured to receive a volume of water therein. The bathing insert 10 additionally includes a drain 26 disposed in the floor 20 and configured to remove water from the bathing insert 10. The bathing insert 10 may further include a port/opening for a faucet or another plumbing fixture, which may be used to introduce water into the cavity 24. In other embodiments the bathing insert 10 may be an insert for a shower stall (e.g., a shower floor piece). The bathing insert 10 may also include seats, shelves, textured surfaces, etc. to improve a user's overall bathing experience.

Figure 3:
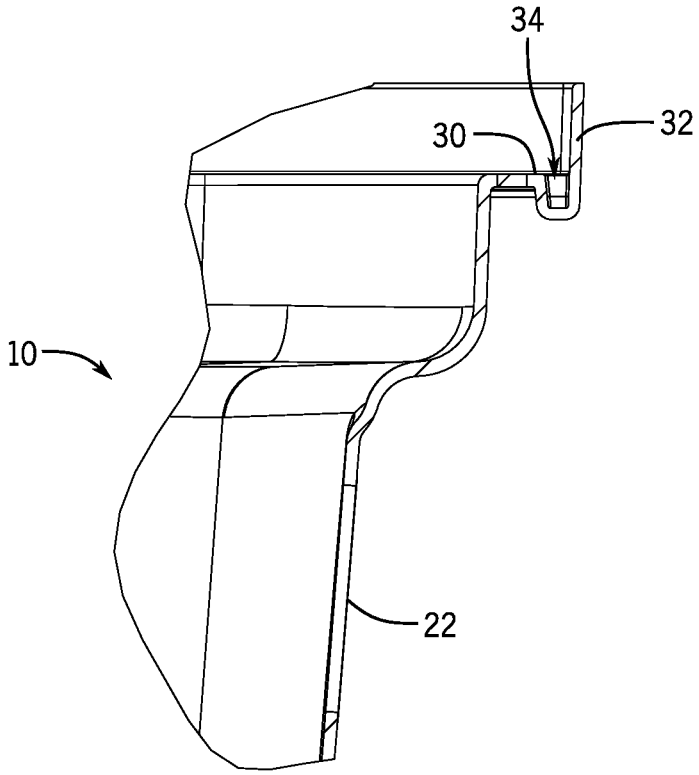
FIG. 3 is a side cross-sectional view of a portion of the bathing insert of FIG. 1.

As shown in FIGS. 2-3, the bathing insert 10 includes an outer flange 28 that extends along a perimeter of the bathing insert 10, along three sides of the bathing insert 10. As shown in FIG. 3, the outer flange 28 includes a horizontal portion 30 and a vertical portion 32 arranged in a substantially perpendicular orientation relative to the horizontal portion 30. Together, the horizontal portion 30 and the vertical portion 32 define a substantially "L" shaped ledge. As shown in FIGS. 2-3, the bathing insert 10 includes a plurality of recessed areas 34 (e.g., slots, etc.) disposed on the outer flange 28 at approximately equal intervals along the perimeter of the bathing insert 10. In other embodiments, more or fewer recessed areas 34 may be provided. Each of the recessed areas 34 is disposed at an intersection between the horizontal portion 30 and the vertical portion 32. Among other benefits, the recessed areas 34 facilitate alignment and positioning of the bath wall assembly 100 relative to the wall panels.

Figure 4:
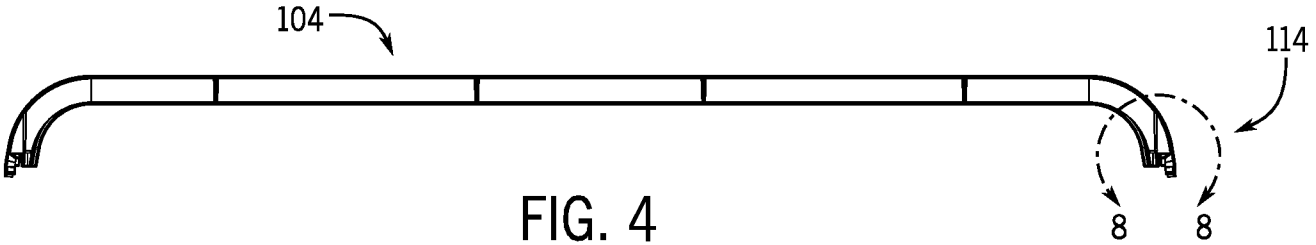
FIG. 4 is a top view of a lower back wall panel of the bath wall assembly of FIG. 1.
Figure 6:
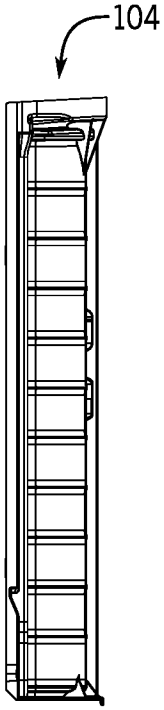
FIG. 6 is a side view of the lower back wall panel of FIG. 4.
Figure 5:
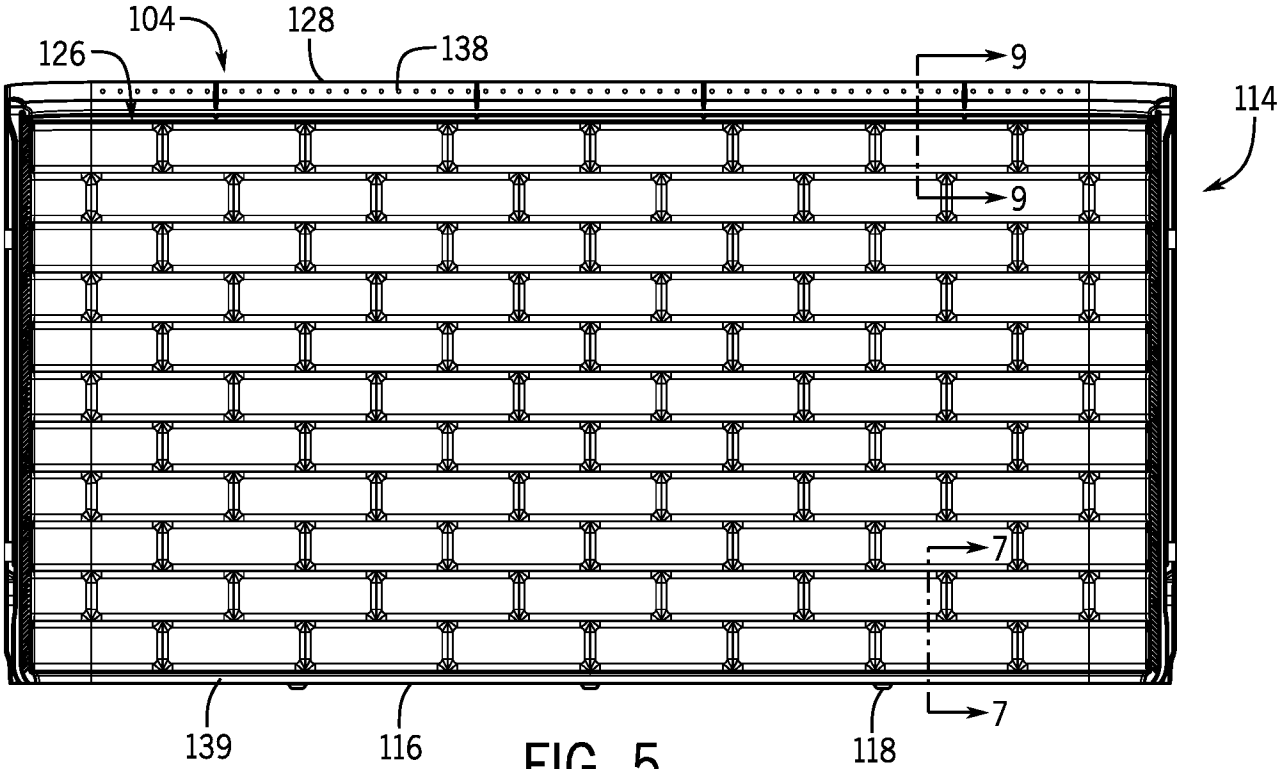
FIG. 5 is a front view of the lower back wall panel of FIG. 4.

FIGS. 4-9 show various views of the lower back wall panel 104 of the bath wall assembly 100 of FIG. 1. As shown in FIG. 4, each lateral end 114 (e.g., a left side end and a right side end as shown in FIG. 4) of the lower back wall panel 104 is curved outwardly in a substantially perpendicular orientation relative to an outwardly facing surface of the lower back wall panel 104. As shown in FIG. 5, the lower back wall panel 104 includes a plurality of tabs 118 (e.g., protrusions, fingers, etc.) extending downwardly from a lower edge 116 in a substantially parallel orientation relative to the lower back wall panel 104. Each one of the plurality of tabs 118 is configured to be received within a corresponding one of the plurality of recessed areas 34 of the bathing insert 10. The plurality of tabs 118 is configured to position the lower back wall panel 104 against the "L" shaped ledge that extends along the perimeter of the bathing insert 10 (see FIGS. 2-3). Engagement between the plurality of tabs 118 and the "L" shaped ledge also prevents the lower back wall panel 104 from moving relative to the bathing insert 10 in a substantially horizontal direction (e.g., parallel to the floor 20 of the bathing insert).

Figure 7:
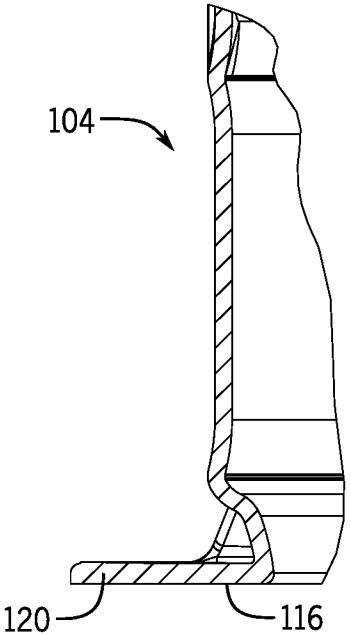
FIG. 7 is a reproduction of FIG. 4 near an end of the lower back wall panel.

As shown in FIG. 7, the lower edge 116 of the lower back wall panel 104 includes a lip 120 (e.g., extension piece, etc.) that extends away from the lower back wall panel 104 in a substantially perpendicular orientation relative to the lower back wall panel 104. The lip 120 is configured to engage with the horizontal portion 30 (e.g., to sit on the horizontal portion 30) of the outer flange 28 such that a rearmost edge of the lip 120 is proximate to the vertical portion 32 of the outer flange 28. Advantageously, the outer flange 28 (e.g., the vertical portion 32) substantially prevents water from leaking into the surrounding structure of the bathing enclosure 12, as any water passing between the lip 120 and the horizontal portion 30 would need to overcome the force of gravity to bypass the vertical portion 32 (see also FIGS. 2-3). The outer flange 28 provides a water-tight seal without the use of a sealant material, which simplifies assembly and the overall aesthetic of the bathing enclosure 12.

Figure 8:
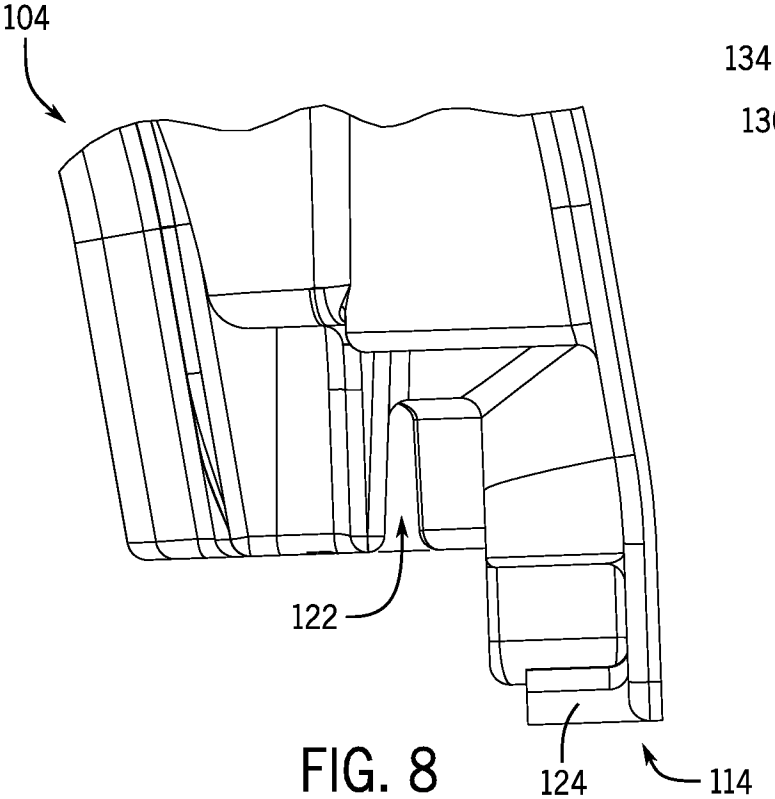
FIG. 8 is a side cross-sectional view through a lower portion of the lower back wall panel of FIG. 4.

The lower back wall panel 104 includes a plurality of channels configured to facilitate sealing between adjacent panels and to help prevent movement of the panels relative to one another once installed. FIG. 8 shows a top view of the lower back wall panel 104 near a lateral end 114 on a right side of the lower back wall panel 104. As shown in FIG. 8, each lateral end 114 of the lower back wall panel 104 includes a lateral channel 122 that extends in a substantially vertical direction along an entire length of the lower back wall panel 104. The lateral channel 122 is sized to receive an extension piece of the right side end wall panel 108 therein in a tongue in groove arrangement to substantially prevent water from leaking through a vertical seam formed between the lower back wall panel 104 and the right side end wall panel 108. As shown in FIG. 8, the lower back wall panel 104 additionally includes a locking member 124. The locking member 124 is a substantially "U" shaped tab or extension that is configured to slidably engage with the right side end wall panel 108 to secure the right side end wall panel 108 in position with respect to the lower back wall panel 104 (e.g., to prevent movement of the right side end wall panel 108 relative to the lower back wall panel 104 in a horizontal direction).

Figure 9:
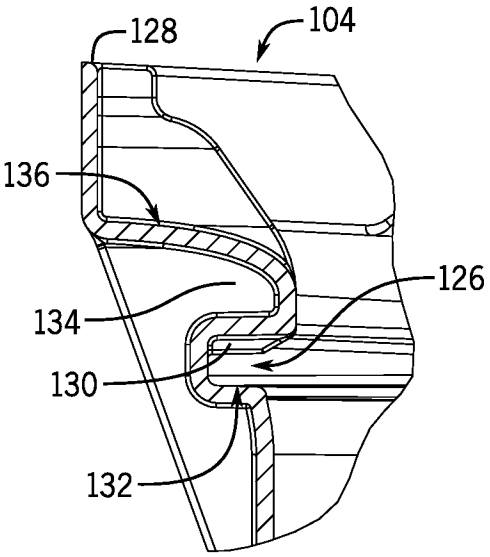
FIG. 9 is a side cross-sectional view through an upper portion of the lower back wall panel of FIG. 4.

As shown in FIG. 5, the lower back wall panel 104 includes a channel 126 that is sized to receive a flange 127 (see FIG. 1) of the upper back wall panel 102 therein. The channel 126 extends along an upper edge 128 of the lower back wall panel 104, between lateral ends 114 of the lower back wall panel 104 (e.g., between a left and right side of the lower back wall panel 104). The channel 126 is configured to extend horizontally along the bath wall assembly 100 in a substantially parallel orientation relative to the floor 20 of the bathing insert 10 (see FIG. 1). As shown in FIG. 9, the channel 126 is substantially rectangular. The channel 126 is disposed a distance below the upper edge 128 in a vertical direction to substantially prevent any water trapped near a horizontal seam between the upper back wall panel 102 and the lower back wall panel 104 from reaching the structural wall.

As shown in FIG. 9, an upper surface 130 of the channel 126 protrudes outwardly beyond a lower surface 132 of the channel 126. In other words, a length of the upper surface 130 normal to the lower back wall panel 104 is greater than a length of the lower surface 132. Among other benefits, increasing the length of the upper surface 130 reduces the likelihood of water leaking through the horizontal seam formed between the upper back wall panel 102 and the lower back wall panel 104. As shown in FIG. 9, the upper surface 130 is defined by a finger 134 that extends outwardly from the lower back wall panel 104 in a substantially perpendicular orientation relative to the lower back wall panel 104. An upper portion 136 of the finger 134 is curved downwardly at an approximately 90° angle toward the upper surface 130. The orientation of the upper portion 136 directs any water trapped on a dry side of the bath wall assembly 100 toward the channel 126 (e.g., toward the horizontal seam between the upper back wall panel 102 and the lower back wall panel 104).

As shown in FIG. 5, the lower back wall panel 104 is perforated along the upper edge 128 with a plurality of openings 138. Each opening 138 is configured to receive a fastener (e.g., a screw, nail, bolt, etc.), which is used to couple the lower back wall panel 104 to the structural wall. In other exemplary embodiments, the size, position, and number of openings 138 may be different.

As shown in FIG. 5, the lower back wall panel 104 additionally includes a rounded protrusion 139 that extends along a portion of the lower edge 116 of the lower back wall panel 104. The rounded protrusion 139 extends outwardly from the lower back wall panel 104 in a substantially perpendicular orientation relative to the lower back wall panel 104. As shown in FIG. 1, the rounded protrusion 139 at least partially conceals a horizontal seam formed between the lower back wall panel 104 and the bathing insert 10 such that it is hidden from a user looking vertically downward toward the horizontal seam.

Figure 13:
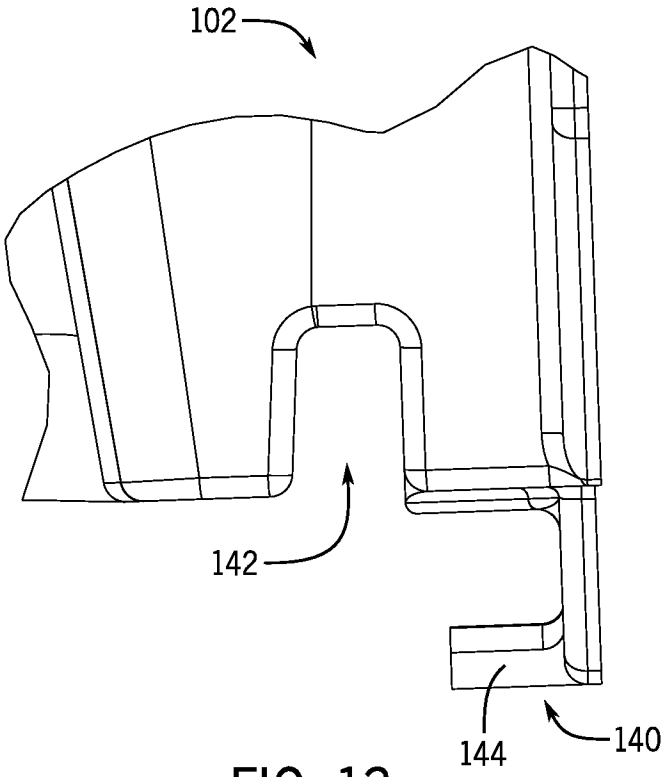
FIG. 13 is a reproduction of FIG. 10 near an end of the upper back wall panel.

FIGS. 10-14 show various views of the upper back wall panel 102 for the bath wall assembly 100 of FIG. 1. Similar to the lower back wall panel 104 of FIGS. 4-9, each lateral end 140 of the upper back wall panel 102 of FIGS. 10-14 is curved outwardly in a substantially perpendicular orientation relative to an outwardly facing surface of the upper back wall panel 102. The upper back wall panel includes a plurality of channels configured to facilitate sealing with adjacent panels and to help prevent movement of the panels relative to one another. FIG. 13 shows a top view of the upper back wall panel 102 near a lateral end 140 on a right side of the upper back wall panel 102. The upper back wall panel 102 is shown to include a lateral channel 142, similar to the lateral channel 122 of the lower back wall panel 104 of FIG. 8. The lateral channel 142 extends in a substantially vertical direction along an entire length of the upper back wall panel 102. The lateral channel 142 is sized to receive an extension piece of the right side end wall panel 108 therein in a tongue in groove arrangement to substantially prevent water from leaking through a vertical seam formed between the upper back wall panel 102 and the right side end wall panel 108. The lateral channel 142 in the upper back wall panel 102 is configured to align with a corresponding one of the lateral channels 122 in the lower back wall panel 104. Together, the lateral channels 122, 142 in the upper back wall panel 102 and the lower back wall panel 104 define an end wall channel that extends along a combined height of the upper back wall panel 102 and the lower back wall panel 104. As shown in FIG. 13, the upper back wall panel 102 additionally includes a locking member 144, which may be the same or similar to the locking member 124 of the lower back wall panel 104.

Figures 10, 11, 12:
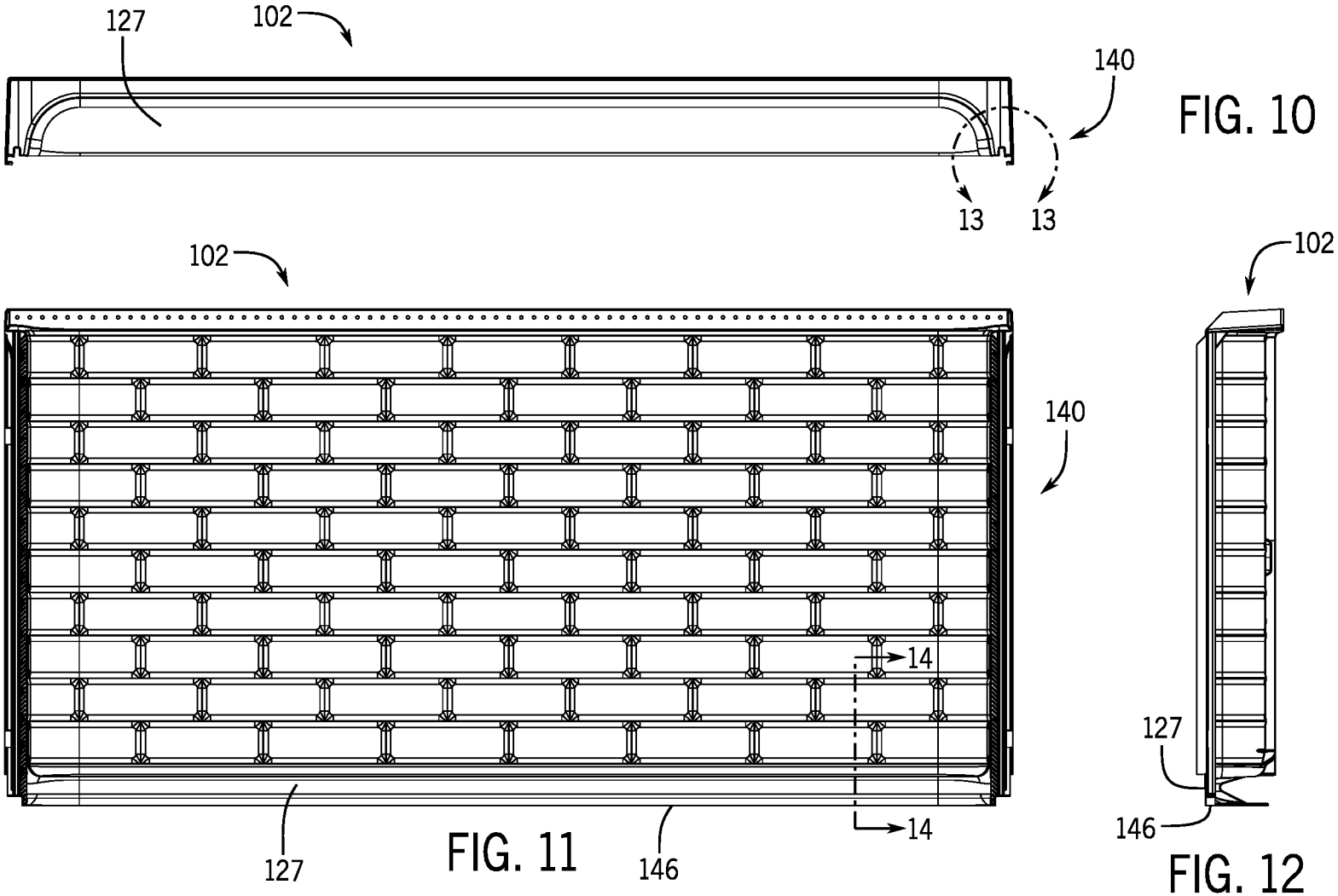
FIG. 10 is a top view of an upper back wall panel of the bath wall assembly of FIG. 1.
FIG. 11 is a front view of the upper back wall panel of FIG. 10.
FIG. 12 is a side view of the upper back wall panel of FIG. 10.
Figure 14:
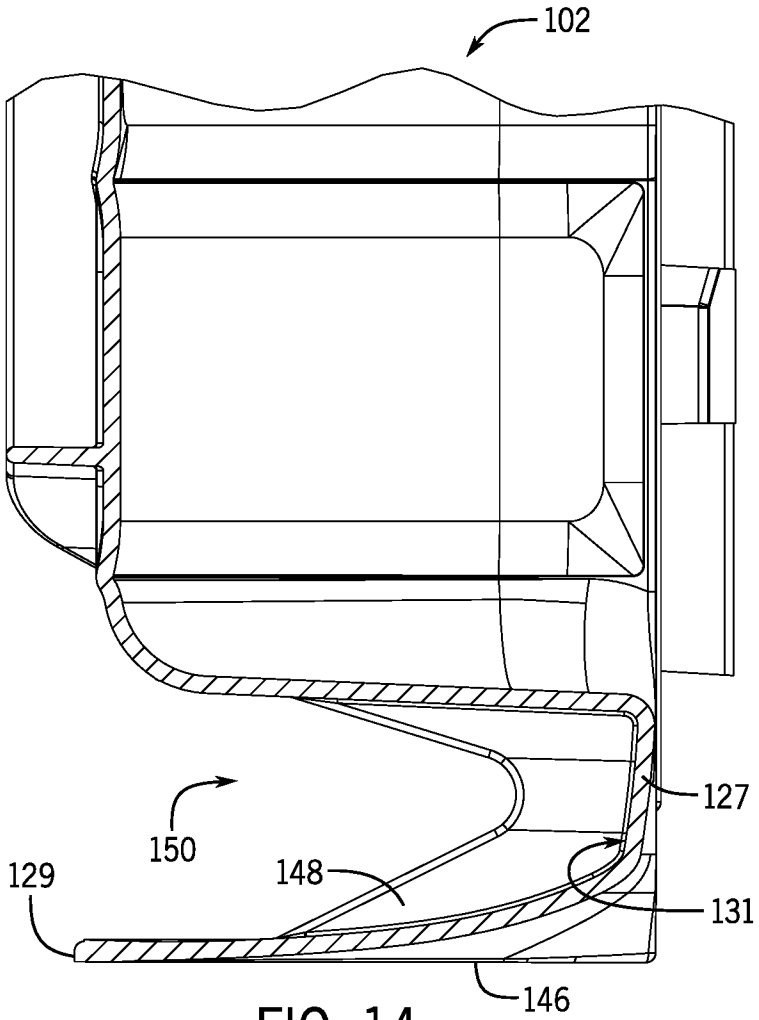
FIG. 14 is a side cross-sectional view through a lower portion of the upper back wall panel of FIG. 10.

As shown in FIGS. 10-12, the upper back wall panel 102 includes a flange 127 that extends at least partially along a lower edge 146 of the upper back wall panel 102, in between lateral ends 140 of the upper back wall panel 102. FIG. 14 shows a side cross-sectional view through the flange 127. The flange 127 is integrally formed with the upper back wall panel 102 as a single unitary structure. As shown in FIG. 14, the flange 127 extends outwardly from the upper back wall panel 102 in a substantially perpendicular orientation relative to the upper back wall panel 102. As shown in FIG. 1, the flange 127 defines a shelf for the bathing enclosure 12 onto which a user may place various bathing accessories such as shampoos, soaps, sponges, etc.

The flange 127 is configured to be received within the channel 126 (see also FIG. 9) and to prevent movement of the upper back wall panel 102 relative to the lower back wall panel 104 in a vertical direction (e.g., parallel to a gravity direction after installation of the bath wall assembly 100). In particular, a lower edge 129 of the flange 127 (see FIG. 14) is sized to be received within the channel 126 and to sealably engage the upper back wall panel 102 with the lower back wall panel 104 without the use of a sealant material. As shown in FIG. 1, the flange 127 at least partially conceals the horizontal seam between the upper back wall panel 102 and the lower back wall panel 104 such that an occupant standing within the bathing enclosure 12 and looking vertically down toward the flange 127 cannot see the horizontal seam. Among other benefits, the position of the flange 127 relative to the horizontal seam improves the overall aesthetic of the bathing enclosure 12. Moreover, the flange 127 also shields the horizontal seam from water (e.g., from a showerhead, etc.) entering the bathing enclosure 12 from above the flange 127, which further prevents water from leaking between the upper back wall panel 102 and the lower back wall panel 104. By shielding the horizontal seam from water, the flange 127 also prevents buildup of dirt, soap, and other residue that would otherwise accumulate along the horizontal seam.

Returning to FIG. 14, the flange 127 defines a substantially "U" shaped channel 131 that extends horizontally along the upper back wall panel 102. The flange 127 additionally includes a plurality of support ribs 148 disposed at approximately equal intervals along a length of the "U" shaped channel 131. Among other benefits, the support ribs 148 prevent structural damage or deformation of the flange 127 under loading. Each of the support ribs 148 defines a substantially "V" shaped notch. In other embodiments, the number, size, and/or spacing of the support ribs 148 within the "U" shaped channel 131 may be different. Together, the flange 127 and the lower back wall panel 104 (e.g., a portion of the lower back wall portion above the finger 134 as shown in FIG. 9) define a hollow interior cavity 150.

Figure 16:
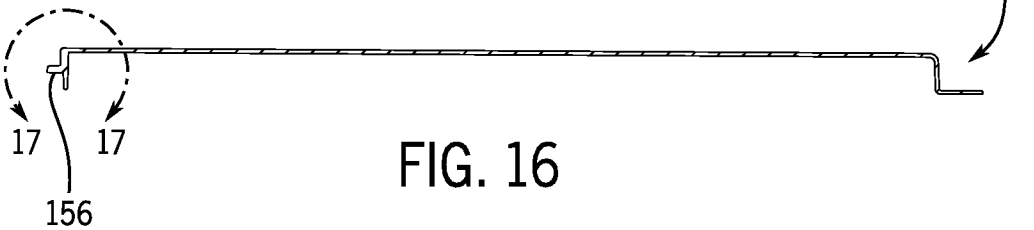
FIG. 16 is a bottom view of the end wall panel of FIG. 15.
Figure 17:
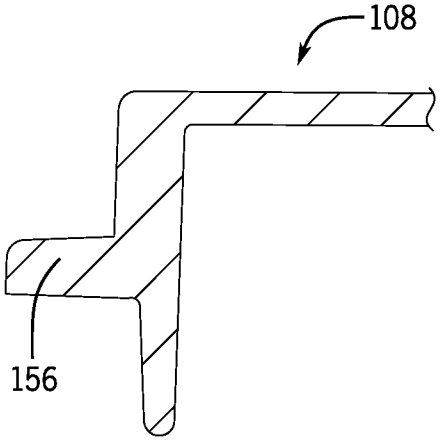
FIG. 17 is a reproduction of FIG. 16 near an end of the end wall panel.
Figure 15:
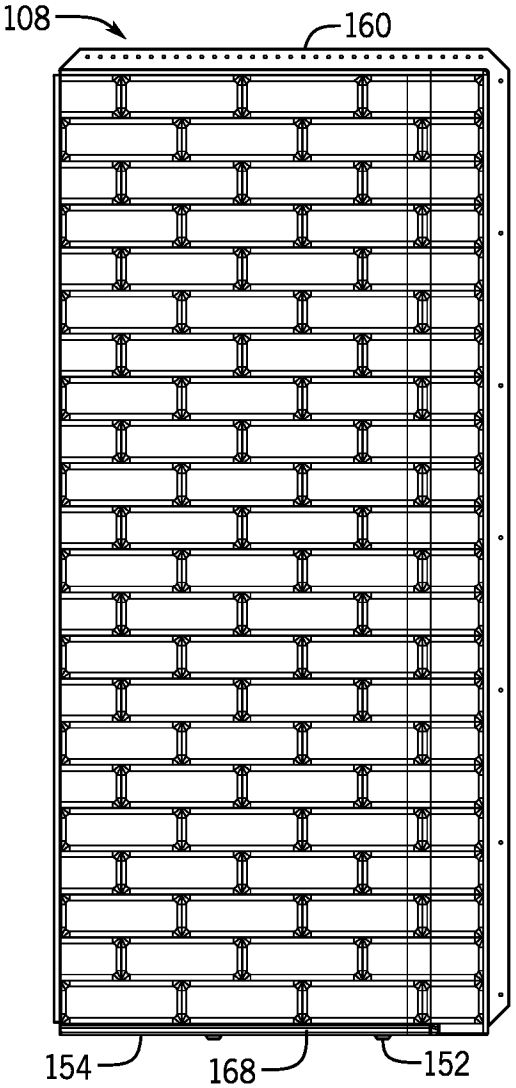
FIG. 15 is a front view of an end wall panel of the bath wall assembly of FIG. 1.

FIGS. 15-20 show various views of the right side end wall panel 108 of the bath wall assembly of FIG. 1. The left side end wall panel 106 is a mirrored version of the right side end wall panel 108 and includes similar elements to the right side end wall panel 108. As shown in FIG. 15, the right side end wall panel 108 includes a plurality of tabs 152 extending downwardly from a lower edge 154 of the right side end wall panel 108 in a substantially parallel orientation relative to the right side end wall panel 108. The tabs 152 may be the same or similar to the tabs 118 of the lower back wall panel 104 of FIG. 5. In particular, the tabs 152 are configured to be received within corresponding recessed areas 34 of the bathing insert 10 to position the right side end wall panel 108 against the "L" shaped ledge that extends along the perimeter of the bathing insert 10 (see FIGS. 2-3). As shown in FIGS. 16-17, the right side end wall panel 108 additionally includes an extension piece 156 that extends between an upper edge 160 and a lower edge 154 of the right side end wall panel 108. The extension piece 156 is a thin rectangular protrusion that extends outwardly from a lateral edge 158 of the right side end wall panel 108 in a substantially parallel orientation relative to the right side end wall panel 108. The extension piece 156 is sized and shaped to be received within an end wall channel formed by a combination of the upper back wall panel 102 and the lower back wall panel 104. The extension piece 156 is configured to sealably engage the end wall channel in a tongue in groove arrangement to substantially prevent water from leaking through a vertical seam along the right side end wall panel 108 without the use of a sealant material.

Figure 18:
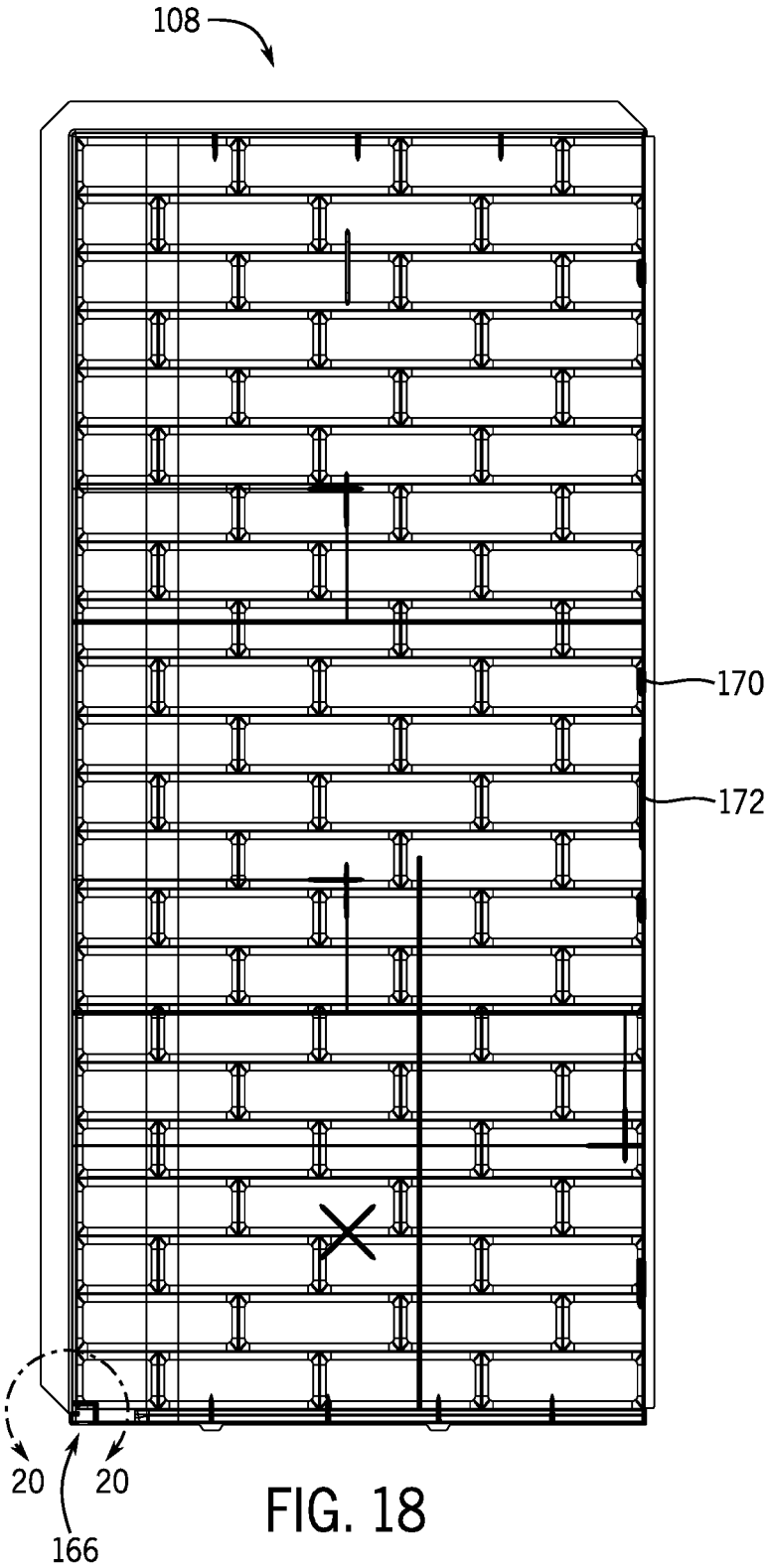
FIG. 18 is a rear view of the end wall panel of FIG. 15.
Figure 19:
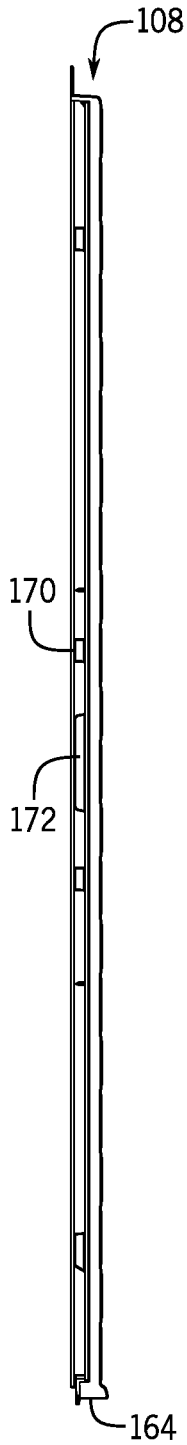
FIG. 19 is a side view of the end wall panel of FIG. 15.
Figure 20:
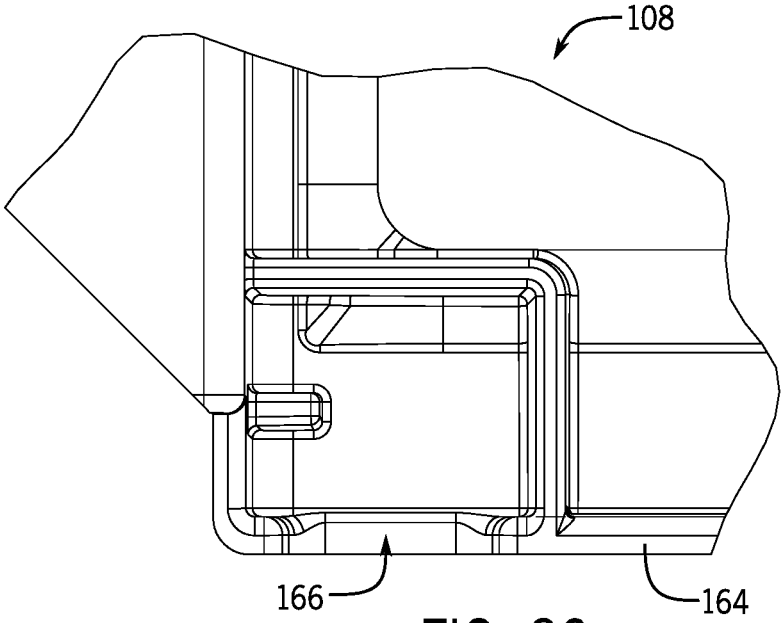
FIG. 20 is a reproduction of FIG. 18 near a lower left-hand corner of the end wall panel.
Figure 21:
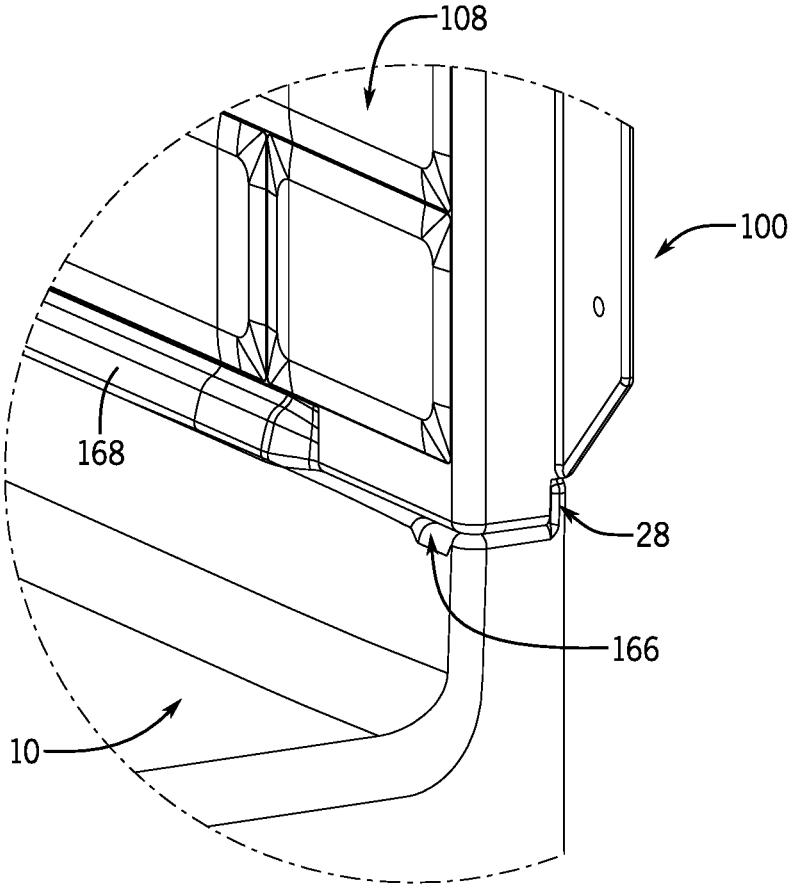
FIG. 21 is a perspective view of the bath wall assembly of FIG. 1 along a forward edge of a seam between the end wall panel and the bathing insert.

FIGS. 18-19 show rear and side views, respectively of the right side end wall panel 108. Similar to the lower back wall panel 104 of FIGS. 4-9, the right side end wall panel 108 includes a lip 164 that is configured to engage with the horizontal portion 30 of the outer flange 28 (see also FIGS. 2-3). As shown in FIGS. 18 and 20, the right side end wall panel 108 additionally includes an opening 166 (e.g., a slot, etc.) disposed in the lip 164 at a location near a lateral end (e.g., an outside vertical edge, etc.) of the right side end wall panel 108. The opening 166 is sized to receive a sealing member, which substantially prevents any water that is captured within an area between panels, along the outer flange 28, from leaking out of the bathing enclosure 12 (e.g., through an end of the flange 28, etc.). In the embodiment of FIGS. 18 and 20, the opening 166 is sized to receive a foam sealing member such as a dry-Block™ water seal from Kohler Co. FIG. 21 shows the right side end wall panel 108 in an installed position in which the right side end wall panel 108 is engaged to the bathing insert 10. As shown in FIG. 21, the bathing insert 10 is chamfered locally, just below the opening 166 to facilitate draining of any water that has pooled along the outer flange 28 back into the bathing insert 10 (see also FIGS. 2-3). In the exemplary embodiment of FIG. 21, the corner radius of the bathing insert 10 is expanded locally to prevent pooling of water along the outer flange 28 on the dry side of the bath wall assembly 100.

As shown in FIGS. 18-19, the right side end wall panel 108 includes a plurality of tabs 170. The tabs 170 are configured to secure the right side end wall panel 108 in position relative to the upper back wall panel 102 and the lower back wall panel 104. In particular, the tabs 170 are configured to engage with corresponding locking members 144 on the upper back wall panel 102 (FIG. 13) and the lower back wall panel 104 (FIG. 8), as will be further described. Additionally, the right side end wall panel 108 is shown to include a sealing tab 172 disposed centrally between adjacent ones of the tabs 170. The sealing tab 172 abuts an end of the horizontal seam between the upper back wall panel 102 and the lower back wall panel 104 when the right end wall panel 108 is secured to the upper back wall panel 102 and the lower back wall panel 104. The sealing tab 172 is configured to substantially cover the end of the horizontal seam to substantially prevent water leakage out of the horizontal seam.

As shown in FIGS. 15 and 21, the right side end wall panel 108 includes a rounded protrusion 168 that extends along a portion of the lower edge 162 of the right side end wall panel 108. The rounded protrusion 168 extends outwardly from the right side end wall panel 108 in a substantially perpendicular orientation relative to the right side end wall panel 108. As shown in FIG. 21, the rounded protrusion 168 at least partially conceals a horizontal seam formed between the right side end wall panel 108 and the bathing insert 10 such that it is hidden from a user standing within the bathing insert 10 and looking vertically downward toward the horizontal seam.

Figure 22:
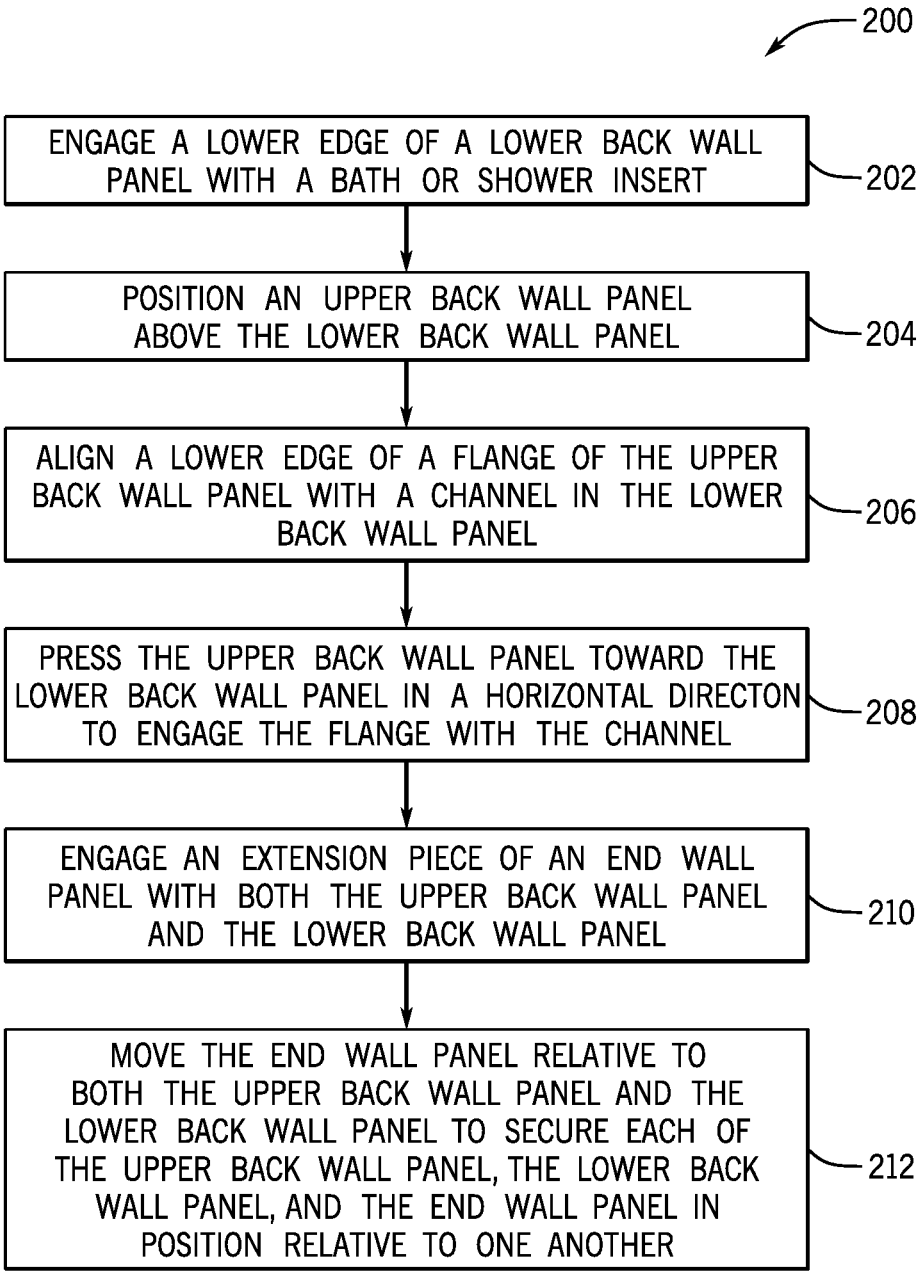
FIG. 22 is a schematic diagram of a method of installing a bath wall assembly for a bathing insert, according to an exemplary embodiment.

Referring now to FIG. 22, a method 200 of installing a bath wall assembly for a bath or shower insert is shown, according to an exemplary embodiment. The bath wall assembly may be the same or similar to the bath wall assembly 100 of FIGS. 1-21. For convenience, similar numbering will be used to identify similar components. The operations described herein may be performed, for example, by a construction worker to install a new bathing insert 10 or by a homeowner to retrofit an existing bath or shower.

Figure 23:
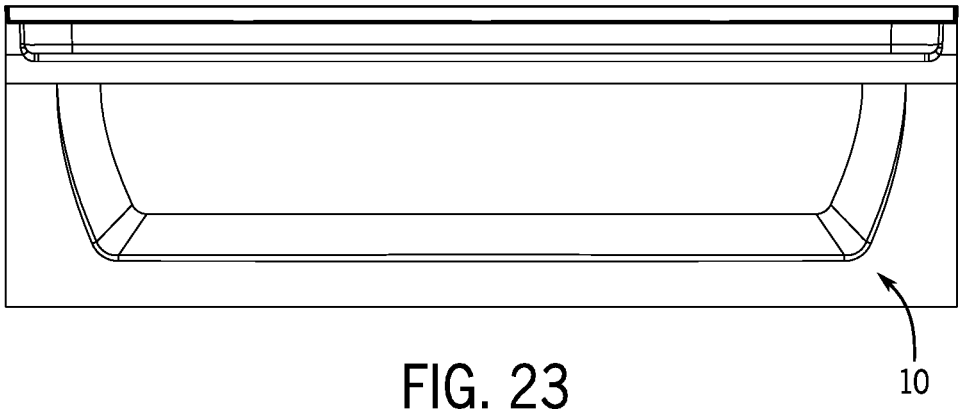
FIG. 23 is a front view of the bathing insert and bath wall assembly of FIG. 1 in a first stage of installation, according to an exemplary embodiment.
Figure 24:
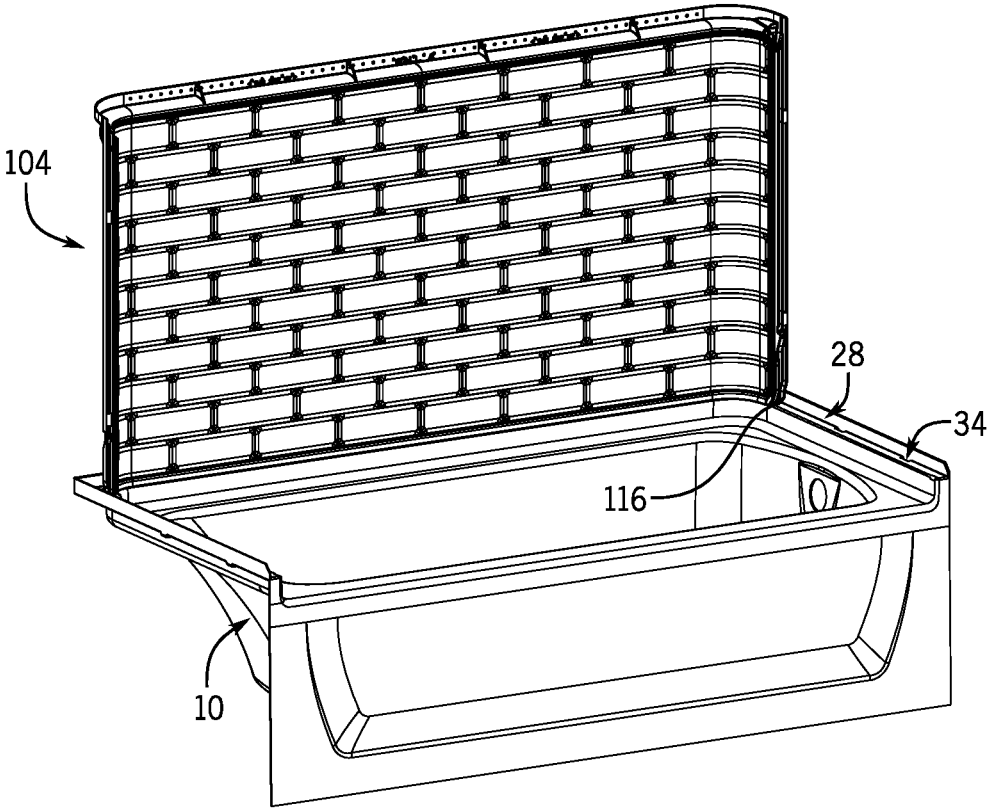
FIG. 24 is a perspective view of the bathing insert and bath wall assembly of FIG. 1 in a second stage of installation, according to an exemplary embodiment.

At 202, a lower edge 116 of a lower back wall panel 104 is engaged with a bath or shower insert (e.g., bathing insert 10). Operation 202 may include providing a bathing insert 10 and positioning the bathing insert 10 within a bathroom environment. Operation 202 may additionally include mounting the bathing insert 10 to a structural wall of the bathroom. FIG. 23 shows a side view of the bathing insert 10 mounted on a structural wall of bathroom prior to installation of the bath wall assembly 100. FIG. 24 depicts installation of the lower back wall panel 104 onto the bathing insert 10. Operation 202 may further include aligning a lower tab 118 of the lower back wall panel 104 with a recessed area 34 of an outer flange 28 of the bathing insert 10 and inserting the tab 118 within the recessed area 34. Operation 202 may also include fastening the lower back wall panel 104 to the structural wall via screws, nails, and adhesive product, and/or another suitable fastener.

Figure 25:
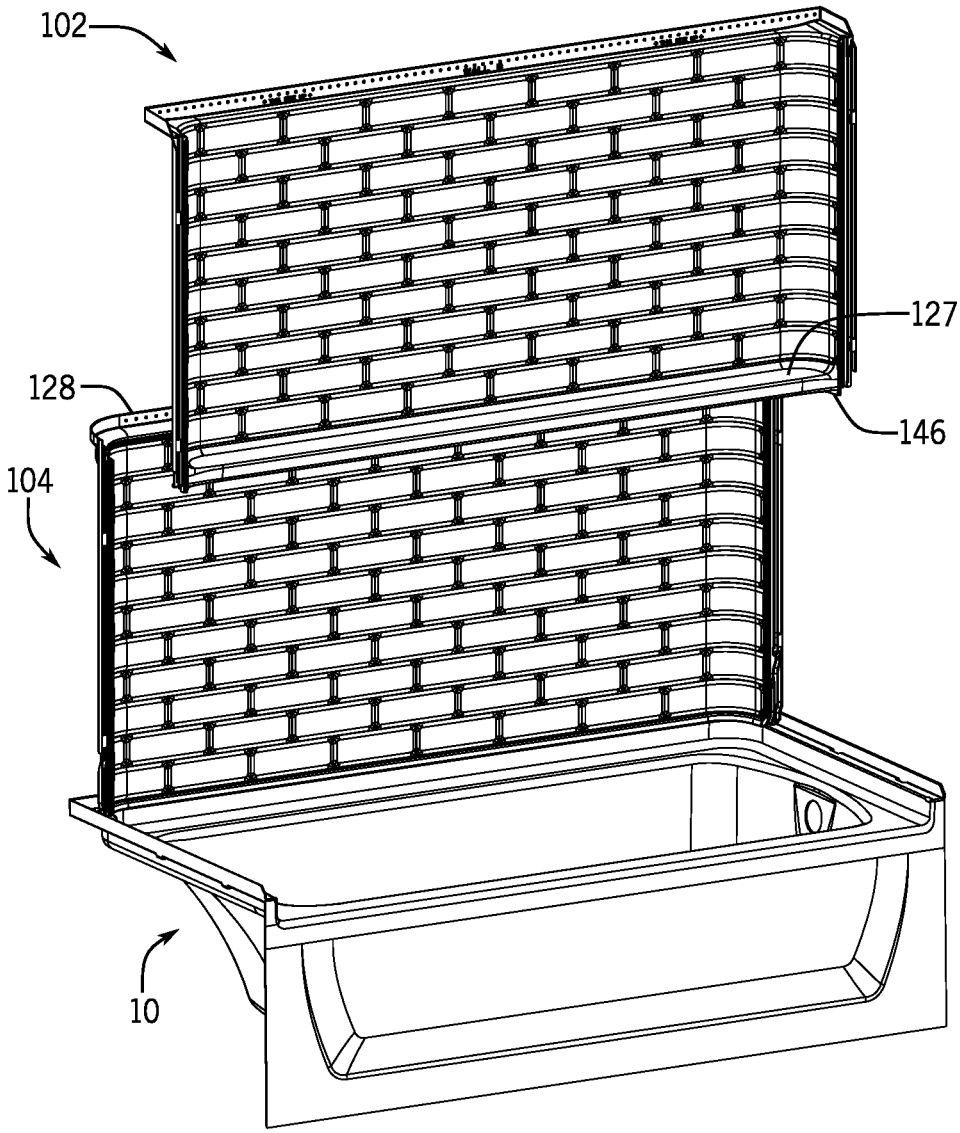
FIG. 25 is a perspective view of the bathing insert and bath wall assembly of FIG. 1 in a third stage of installation, according to an exemplary embodiment.
Figure 26:
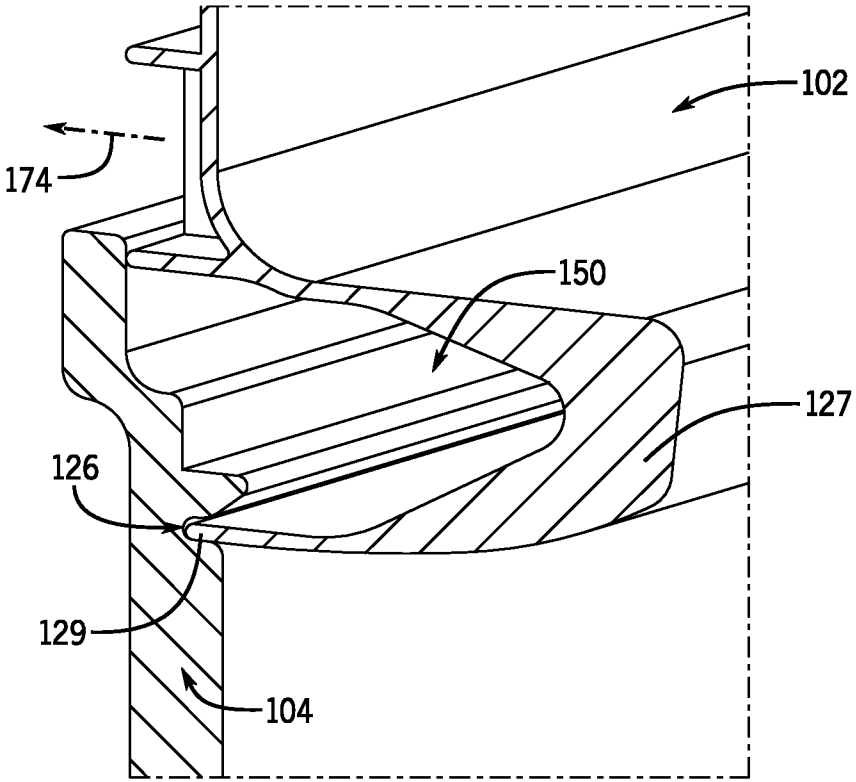
FIG. 26 is a perspective cross-sectional view of a horizontal seam of the bath wall assembly of FIG. 1.

At 204, an upper back wall panel 102 is positioned above the lower back wall panel 104. The upper back wall panel 102 may be positioned such that a lower edge 146 of the upper back wall panel 102 at least partially overlaps the lower back wall panel 104. Operation 204 is depicted conceptually in FIG. 25. At 206, a lower edge 129 of a flange 127 of the upper back wall panel 102 is aligned with a channel 126 in the lower back wall panel 104. As shown in FIG. 26, the lower edge 129 of the flange 127 may be positioned centrally within the channel 126 of the lower back wall panel 104. At 208, the upper back wall panel 102 is pressed toward the lower back wall panel 104 in a horizontal direction 174 to engage the flange 127 with the channel 126.

Figure 27:
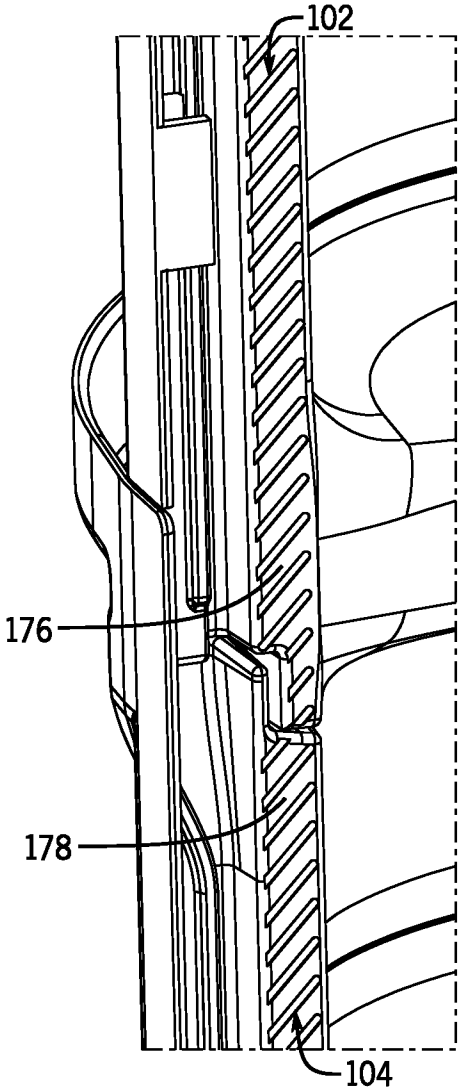
FIG. 27 is a perspective view of the bath wall assembly of FIG. 1 along a horizontal seam.

FIG. 26 shows fitment between the lower edge 129 of the flange 127 and the channel 126 after installation. As shown in FIG. 26, the flange 127 at least partially overlaps the lower back wall panel 104, which, advantageously, improves sealing along a horizontal seam between the upper back wall panel 102 and the lower back wall panel 104. Together, the flange 127 and the lower back wall panel 104 define a hollow interior cavity 150. Operation 208 may additionally include shimming at least one of the upper back wall panel 102 and the lower back wall panel 104 to ensure that a front surface 176 of the upper back wall panel 102 is approximately flush with a front surface 178 of the lower back wall panel 104 as shown in FIG. 27. Operation 208 may further include fastening the upper back wall panel 102 to the structural wall via screws, nails, an adhesive product, and/or another suitable fastener or combination thereof.

At 210, an extension piece 156 of an end wall panel (e.g., right side end wall panel 108) is brought into engagement with the upper back wall panel 102 and the lower back wall panel 104. Operation 210 may include positioning the end wall panel in substantially perpendicular orientation relative to the upper back wall panel 102 and the lower back wall panel 104 at a predefined distance above (e.g., vertically above) the bathing insert 10. Operation 210 may additionally include pressing the end wall panel in a substantially horizontal direction toward the upper back wall panel 102 and the lower back wall panel 104 until the extension piece 156 is fully engaged with an end wall channel formed by the upper back wall panel 102 and the lower back wall panel 104.

Figure 29:
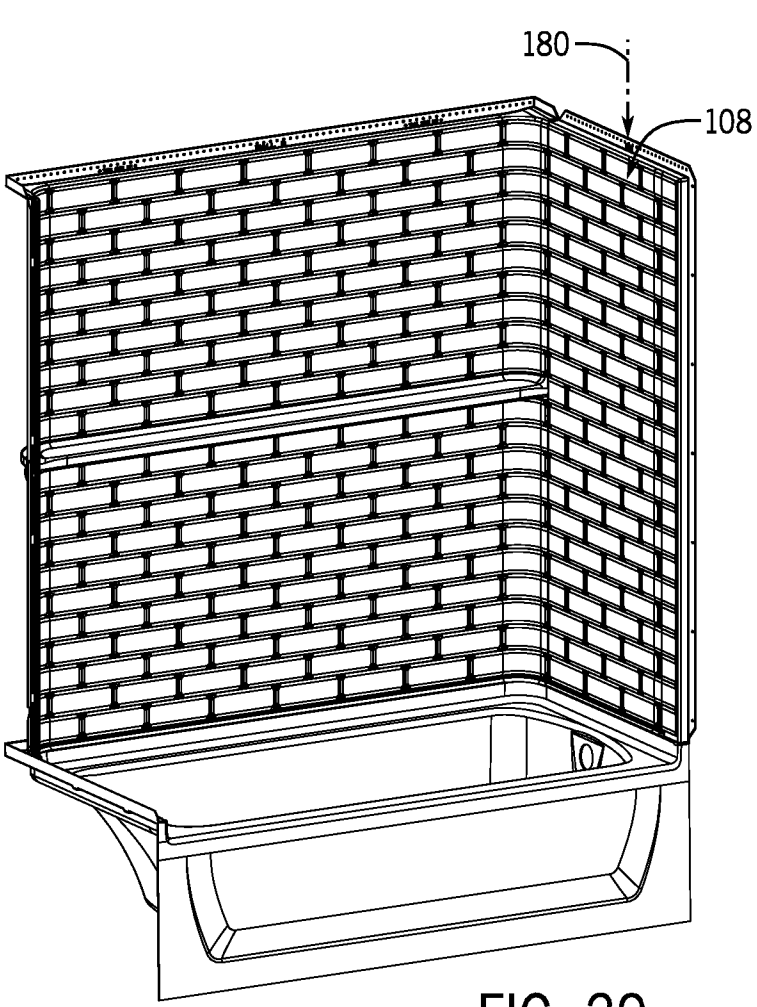
FIG. 29 is a perspective view of the bathing insert and bath wall assembly of FIG. 1 in a fifth stage of installation, according to an exemplary embodiment.
Figure 28:
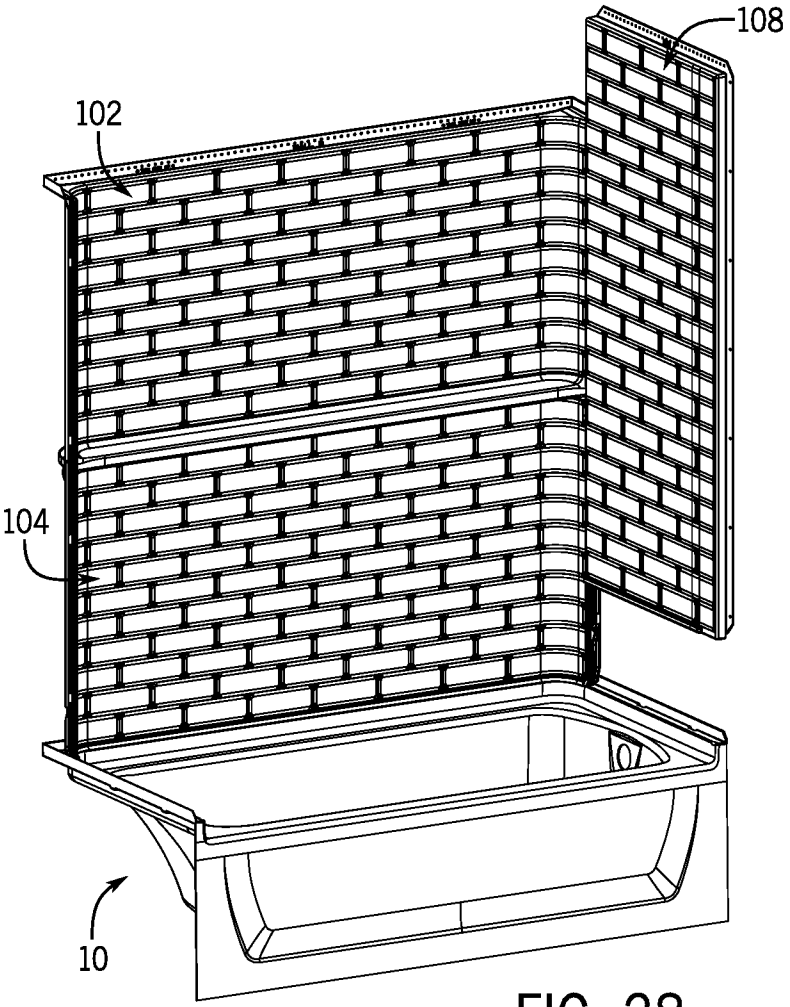
FIG. 28 is a perspective view of the bathing insert and bath wall assembly of FIG. 1 in a fourth stage of installation, according to an exemplary embodiment.
Figure 30:
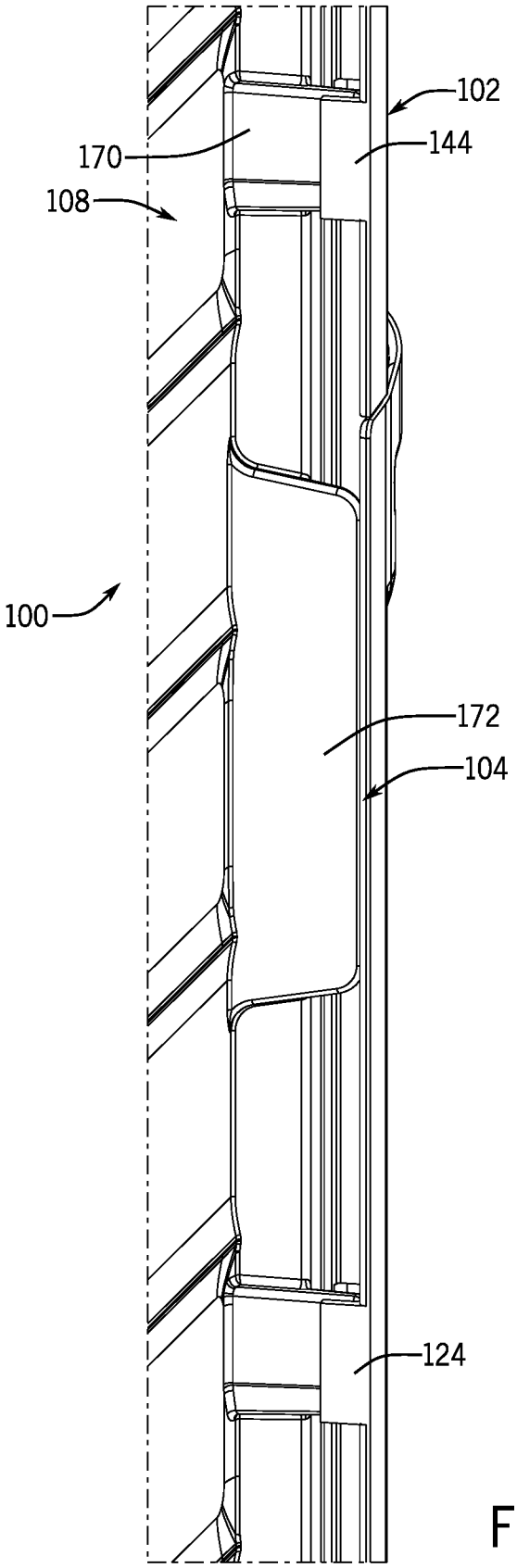
FIG. 30 is a perspective view of the bathing insert of FIG. 1, at a location where end wall panel engages a back wall panel.

At 212, the end wall panel is repositioned relative to both the upper back wall panel 102 and the lower back wall panel 104 to secure each of the upper back wall panel 102, the lower back wall panel 104, and the end wall panel in position relative to one another. Operation 212 is depicted conceptually in FIG. 29. Operation 212 may include applying a downward force in a vertical direction 180 to the end wall panel and sliding the end wall panel toward the bathing insert 10. Operation 212 may further include engaging a tab 170 of the end wall panel with a locking member 124, 144 of at least one of the upper back wall panel 102 and the lower back wall panel 104 as shown in FIG. 30. In some exemplary embodiment, the method includes repeating operations 210 and 212 with a second end wall panel (e.g., a left side end wall panel 106) to complete installation of the bath wall assembly 100. In other exemplary embodiments, the method 200 may include additional, fewer, and/or different operations.

The bath wall assembly, of which various exemplary embodiments are disclosed herein, provides several advantages over existing multi-piece bath enclosures. The bath wall assembly includes back wall section that includes multiple back wall panels, which reduces packaging size and makes the bath wall assembly easier and safer to handle. The mating geometry between adjacent back wall panels provides a water-tight seal without the use of sealant materials, which can be messy and difficult to apply. The back wall panels engage with one another near a flange, which may serve as a shelf for storing various bathing accessories within the bathing enclosure. The flange is received within a channel of a lower back wall panel to prevent relative movement between the panels in a vertical direction and to control an amount of vertical gap that can be induced in the horizontal seam when the panels are installed. The horizontal seam between panels is disposed beneath the flange to at least partially conceal the horizontal seam from a user's view, thereby improving the overall aesthetic of the bathing enclosure.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the application as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the Figures. It should be noted that the orientation of various elements may differ according to other exemplary embodiments, and that such variations are intended to be encompassed by the present disclosure.

It is important to note that the construction and arrangement of the apparatus and system as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments.

Other substitutions, modifications, changes and omissions may also be made in the design, operating conditions and arrangement of the various exemplary embodiments without departing from the scope of the present application. For example, any element disclosed in one embodiment may be incorporated or utilized with any other embodiment disclosed herein.

What is claimed is:

1. A bath wall assembly, comprising:

a first back wall panel configured to be mounted directly to a structural wall of a bathroom, the first back wall panel having a flange extending at least partially along an edge of the first back wall panel, wherein the flange extends outwardly from the first back wall panel in a substantially perpendicular orientation relative to the first back wall panel to define a shelf for the bath wall assembly; and a second back wall panel configured to be mounted directly to the structural wall adjacent to the first back wall panel, the second back wall panel comprising a channel configured to receive a portion of the flange therein and to prevent movement of the first back wall panel relative to the second back wall panel toward and away from each other, wherein together the flange and the channel form a substantially water-tight seam between the first back wall panel and the second back wall panel, and wherein together the flange and the second back wall panel define a hollow interior cavity that is closed off by the flange.

2. The bath wall assembly of claim 1, wherein the flange and the channel are configured to extend in a substantially parallel orientation relative to a floor of a bathing insert.

3. The bath wall assembly of claim 1, wherein the flange at least partially overlaps the second back wall panel when the first back wall panel is engaged with the second back wall panel.

4. The bath wall assembly of claim 1, wherein the first back wall panel is an upper back wall panel, and wherein the second back wall panel is a lower back wall panel configured to be mounted to the structural wall below the first back wall panel.

5. The bath wall assembly of claim 4, wherein the first back wall panel at least partially conceals a horizontal seam formed between the first back wall panel and the second back wall panel beneath the flange when the first back wall panel is engaged with the second back wall panel.

6. The bath wall assembly of claim 1, wherein the flange comprises a substantially "U" shaped channel, and wherein the "U" shaped channel faces in a substantially perpendicular orientation relative to the second back wall panel.

7. The bath wall assembly of claim 1, further comprising an end wall panel, wherein the end wall panel is configured to sealably engage with both the first back wall panel and the second back wall panel without the use of a sealant material.

8. The bath wall assembly of claim 7, wherein at least one of the first back wall panel and the second back wall panel comprise a locking member, and wherein the end wall panel is configured to engage with the locking member to secure each of the first back wall panel, the second back wall panel, and the end wall panel in position relative to one another.

9. The bath wall assembly of claim 7, wherein the end wall panel comprises an extension piece that extends at least partially along an edge of the end wall panel, wherein together the first back wall panel and the second back wall panel are configured to define an end wall channel that extends along a lateral edge of each of the first back wall panel and the second back wall panel, and wherein the extension piece is configured to engage with the end wall channel.

10. The bath wall assembly of claim 1, wherein the channel is configured to receive a lower edge of the flange therein.

11. A bath wall assembly, comprising:

an upper back wall panel configured to be mounted directly to a structural wall of a bathroom, the upper back wall panel comprising a flange extending at least partially along a lower edge of the upper back wall panel, wherein the flange extends outwardly from the upper back wall panel in a substantially perpendicular orientation relative to the upper back wall panel to define a shelf for the bath wall assembly; and a lower back wall panel configured to be mounted directly to the structural wall, the lower back wall panel configured to be positioned below the upper back wall panel, the lower back wall panel comprising a channel extending at least partially along an upper edge of the lower back wall panel, the channel configured to receive a portion of the flange therein to form a substantially water-tight seam between the upper back wall panel and the lower back wall panel and to prevent movement of the upper back wall panel relative to the lower back wall panel toward and away from each other, and wherein the upper back wall panel at least partially conceals a horizontal seam formed between the upper back wall panel and the lower back wall panel beneath the flange when the upper back wall panel is engaged with the lower back wall panel, and wherein together the flange and the second back wall panel define a hollow interior cavity that is closed off by the flange.

12. The bath wall assembly of claim 11, wherein the portion of the flange is configured to sealably engage with the channel without the use of a sealant material.

13. The bath wall assembly of claim 11, wherein the flange at least partially overlaps the lower back wall panel when the upper back wall panel is engaged with the lower back wall panel.

14. The bath wall assembly of claim 11, wherein the flange comprises a substantially "U" shaped channel, and wherein the "U" shaped channel faces in a substantially perpendicular orientation relative to the second back wall panel.

15. The bath wall assembly of claim 11, further comprising an end wall panel configured to sealably engage with both the upper back wall panel and the lower back wall panel without the use of a sealant material, wherein at least one of the upper back wall panel and the lower back wall panel comprise a locking member, and wherein the end wall panel is configured to engage with the locking member to secure each of the lower back wall panel, the upper back wall panel, and the end wall panel in position relative to one another.

* * * * *